United States Patent [19]

Helwick

[11] Patent Number: 4,754,534

[45] Date of Patent: Jul. 5, 1988

[54] JEWELRY CLIP

[76] Inventor: Carol S. Helwick, 14 Dunsinane Rd., Brookfield Center, Conn. 06805

[21] Appl. No.: 3,556

[22] Filed: Jan. 15, 1987

[51] Int. Cl.[4] ..... F16G 15/04

[52] U.S. Cl. ..... 24/543; 24/116 A; 63/2

[58] Field of Search ..... 24/542, 543, 544, 616, 24/618, 116 A; 63/2, 4

[56] References Cited

U.S. PATENT DOCUMENTS

| | | | |
|---|---|---|---|
| De. 57,180 | 2/1921 | Miller | 63/4 |
| 1,459,382 | 6/1923 | Wagner | 24/543 |
| 1,505,461 | 8/1924 | Guyot et al. | 24/543 |
| 1,534,586 | 4/1925 | Harrison | 63/4 |
| 1,746,054 | 2/1930 | Ridabock | 24/116 A |
| 1,813,963 | 7/1931 | Schick | 24/616 |
| 3,023,473 | 3/1962 | Cochran | 24/543 |
| 3,168,768 | 2/1965 | Bohlinger et al. | 24/116 A |
| 3,181,217 | 5/1965 | Bohlinger et al. | 24/116 A |
| 3,225,565 | 12/1965 | Bohlinger et al. | 24/116 A |
| 4,530,221 | 7/1985 | Weinberg | 24/116 A |
| 4,628,708 | 12/1986 | Ivey | 63/2 |

FOREIGN PATENT DOCUMENTS

| | | | |
|---|---|---|---|
| 8001752 | 9/1980 | PCT Int'l Appl. | 24/542 |
| 243226 | 11/1925 | United Kingdom | 24/542 |

*Primary Examiner*—Victor N. Sakran

*Attorney, Agent, or Firm*—Murray J. Kessler

[57] ABSTRACT

A clip assembly containing a resilient filler that secures chain jewelry when snapped closed over the chains.

1 Claim, 1 Drawing Sheet

JEWELRY CLIP

SUMMARY OF INVENTION

For some time, certainly long enough not to be considered a fad, gold and silver chains have been worn, primarily by women, as fashion accessories. These chains are usually of moderate diameter, and frequently two or more chains are worn at the same time. When multiple chains are worn, body movement causes the chains to interact, bunch together at the shoulder area and twist and tangle down the front, creating an unsightly appearance.

To date there have been no simple or attractive-looking solutions to the tangle problems of multiple chains. The present invention, used in pairs, provides that solution both in a simple and attractive manner by securing the chains in place, separated from one another at both shoulders and due to the dynamics of chains, keeps them from tangling.

The wearer simply selects and puts on the chains in whatever orientation desired, then slips the open jewelry clip over the chains at the shoulder and snaps it closed. The chains are held in place by the resilient filler. A second jewelry clip is placed on the chains at the other shoulder, thereby fixing the orientatin of the chains as desired. The clip may be finished in a decorative manner so that the clip itself may be considered a piece of jewelry.

DETAILED DESCRIPTION

Figure 1:
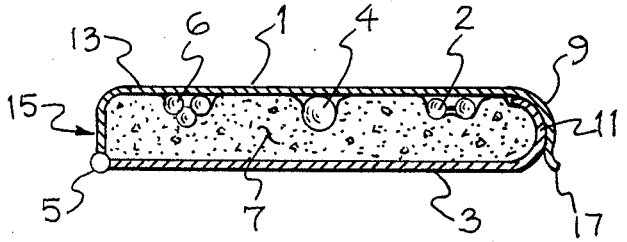
FIG. 1. Shows a cross-sectional side view of the invention.
Figure 2:
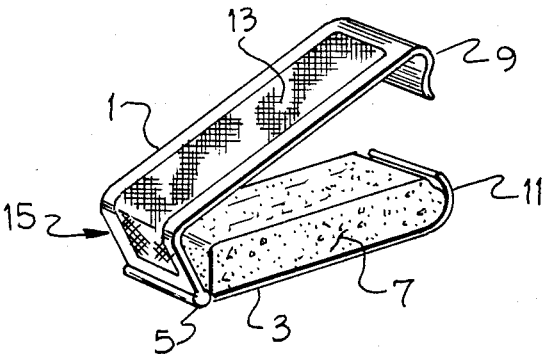
FIG. 2. Shows an oblique view of the invention in an open state.
Figure 3:
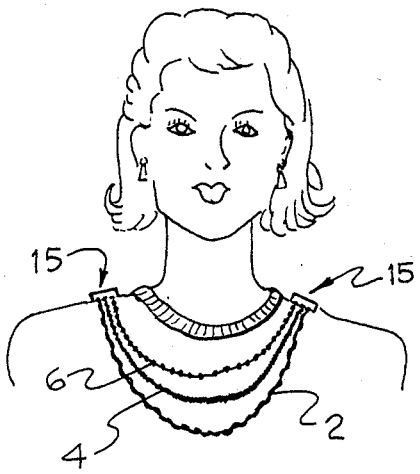
FIG. 3. Shows the invention in application.

Referring to FIGS. 1 and 2 the invention (15) has an upper member (1) fabricated of suitable elastic material and affixed to the lower member (3), also fabricated of a suitable elastic material, by means of pivoting, such as a hinge (5). Affixed to the inner surface of the lower member (3) from hinge end to formed end is a filler of non-absorbent resilient material (7), such as polyurethane sponge or silicone rubber, sized to adequately cover the inner surface of the member for adhesion purposes and to maintain stability of the filler and of sufficient thickness to just clear the opposing member when the upper member (1) is pivoting against the lower member (3). The ends of the upper member (9) and lower member (11) opposite the pivot means (5) are shaped so the upper member (1) will snap over and be captured by the lower member (3), as shown in FIG. 1. The filler may be affixed to either member; it is shown here affixed to the lower member (3). The end of the upper member (9) has a protrusion (17) at an angle to guide the upper member end (9) over the lower member end (11), the protrusion (17) can also be used by the user to open the clip by sliding a fingernail under the protrusion and lifting. In application, referring to FIG. 3, the wearer takes the jewelry (15) and places the chains to be worn (2), (4), (6) in the open clip (15), snaps the upper member (1) down against the lower member (3). The chains are pressed into the resilient material of the filler (7) by the pressure of the upper member. The resilient material of the filler (7) deforms around chains and holds them in place. The wearer repeats the application on the other side. The outer surface (13) of either member can be finished in or mounted with items of jewelry quality.

I claim:

1. Jewelry accessory clips, used in pairs in combination with two or more ornamental chains, each said clip is comprised of a pair of members, connected at one end by pivot means, which means is a hinge and movable from an open position, each member having opposing flat surfaces and made of material of proper tensile strength and elasticity having the ends, opposite the pivoting means, formed so that the upper member snaps over and is captured by the similarity formed and opposing end of the lower member, the upper member having a slight angled protrusion at the tip providing both enough pressure so that a wearer can use a fingernail to unsnap the ends of the two members, and sufficient protrusion to guide said upper member over the lower member, the dimensions and fabrication of the ends of two members when snapped closed orient the opposing flat surfaces parallel to one another; affixed to one of the paralleled opposing surfaces is a filler of non-absorbent resilient material of sufficient length to fit entirely between the pivot and the formed ends of the lower member, of sufficient width to be affixed stably to its surface and high enough to just approach but not touch the opposing surface when the clip is snapped closed, so that any ornamental chain placed between the members will be pressed into the resilient material of said filler by the pressure of the opposing member when the members are snapped closed.

* * * * *